United States Patent [19]

Meisser et al.

[11] 4,438,886

[45] Mar. 27, 1984

[54] DOUBLE WIRE-WINDING MACHINE WITH AUTOMATIC TRANSFER

[75] Inventors: Marc Meisser, Meyrin; Kurt Weber, Echandens; Louis Veyrassat, Rolle, all of Switzerland

[73] Assignee: Maillefer S.A., Ecublens, Switzerland

[21] Appl. No.: 250,917

[22] Filed: Apr. 3, 1981

[30] Foreign Application Priority Data

Apr. 11, 1980 [CH] Switzerland ..... 2813/80
Dec. 10, 1980 [CH] Switzerland ..... 9110/80

[51] Int. Cl.[3] ..... B65H 54/02
[52] U.S. Cl. ..... 242/25 A
[58] Field of Search ..... 242/25 A, 25 R, 18 A, 242/18 PW

[56] References Cited

U.S. PATENT DOCUMENTS 3,596,844 8/1971 Engmann ..... 242/25 A
3,620,482 11/1971 Bravin ..... 242/25 A
4,119,278 10/1978 Draizen et al. ..... 242/25 A

FOREIGN PATENT DOCUMENTS 2529764 1/1976 Fed. Rep. of Germany ... 242/25 A
47-35265 9/1972 Japan ..... 242/25 A
1309733 3/1973 United Kingdom ..... 242/25 A

*Primary Examiner*—Stanley N. Gilreath
*Attorney, Agent, or Firm*—Parkhurst & Oliff

[57] ABSTRACT

A double winding machine for winding wire on reels includes two reel supports with drive shafts. Each support is equipped with a snagging mechanism comprising a hook-bearing disk with hook, an uncoiling member, and a bearing for supporting the disk and the uncoiling member coaxially with the reel and for allowing relative displacement of the disk and uncoiling member between an initial and a displaced position. A disengageable coupler is provided to rotationally couple the disk, uncoiling member and reel. The coupler can be translationally disengaged. Brakes are provided for the disk to produce a lag between the disk and reel to lengthen the leading end of the wire. The relative displacement is performed with the lag, allowing the leading end to be retained in the hook and uncoiling member. The leading end is thus made accessible, even after winding is complete.

19 Claims, 14 Drawing Figures

DOUBLE WIRE-WINDING MACHINE WITH AUTOMATIC TRANSFER

Figure 1:
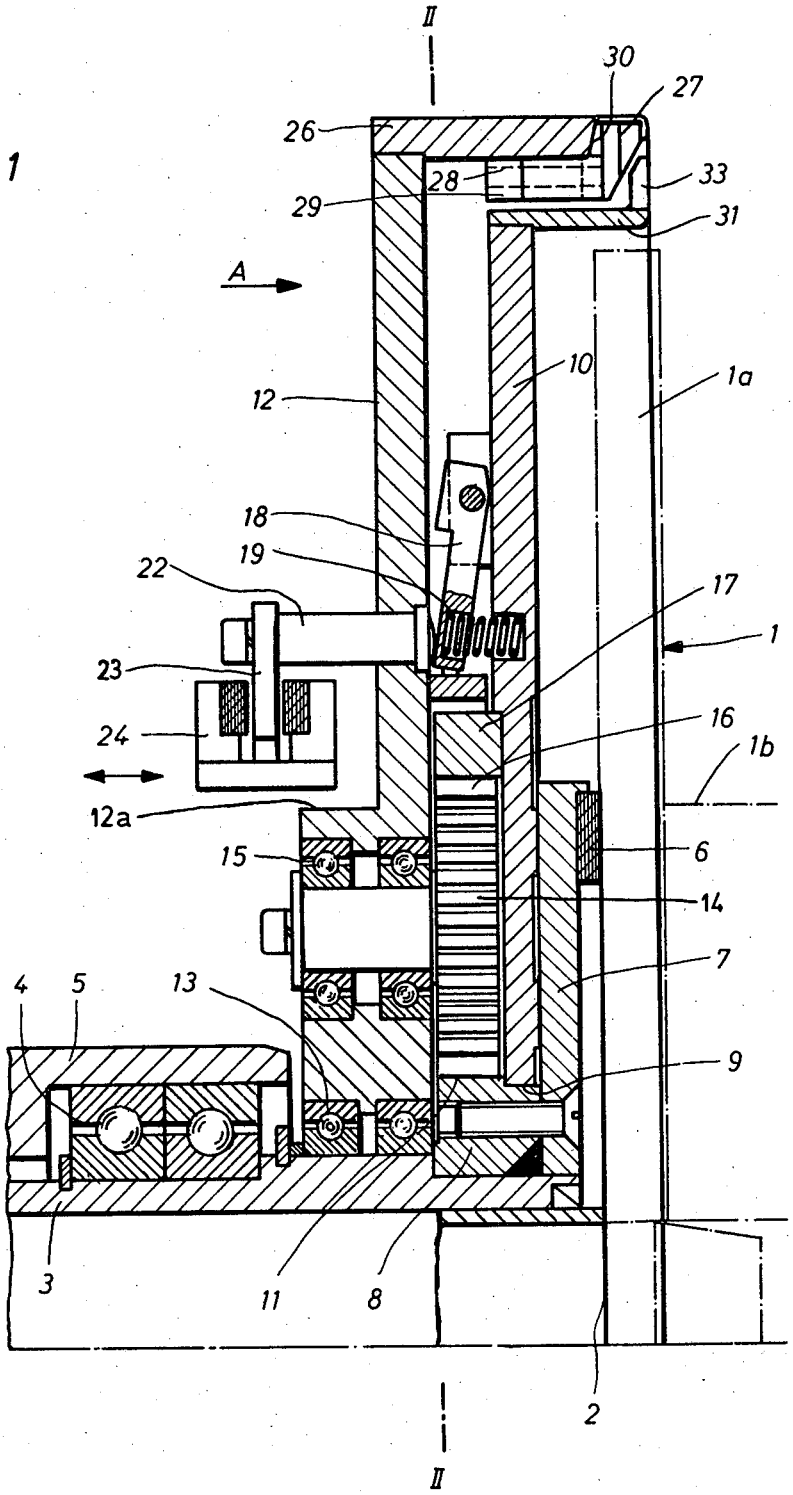

This invention relates to winding machines, and more particularly to a double winding machine with automatic transfer for continuously winding metal wire on reels, of the type comprising two reel supports having parallel drive shafts and each equipped with a mechanism for snagging the leading end of the wire to be wound, this mechanism comprising a hook-bearing disk coaxial with the reel, and control means capable of producing, at the beginning of each winding operation, a lag of the hook-bearing disk relative to the drive shaft in order to lengthen the leading end.

At the present time, winding machines can be constructed which are capable of winding standard reels with insulated metal wire, such as telephone wire, at speeds of up to 2,500 meters per minute. In most of these machines, at the moment of transfer, the wire is snagged on a hook mounted on a disk which rotates coaxially with the empty reel. From this hook, the wire stretches in a straight line tangent to the barrel of the reel and then forms turns which are laid side by side in successive layers during the course of winding. As a result, the straight piece of wire at the leading end of the coil is generally buried in the latter and is not accessible. However, for various reasons it is desirable that the leading end be disengaged from the coil for a sufficient length to be easily accessible once the reel is completely wound, and winding-machine arrangements have already been proposed for forming a leading end accessible at the beginning of the coil on the reels.

Thus, in one proposed design, an example of which is described in U.K. Pat. No. 1,309,733, the wire-snagging member is mouted on a disk coaxial with the reel and rotatable relative to the drive shaft thereof. Normally, this disk rotates with the drive shaft and the reel; but after the transfer, it can be subjected to the action of a brake so that it describes a relative lagging movement, slightly unwinding the length of wire adjacent to the end held by the snagging member. Under the effect of centrifugal force, this length of wire is disengaged from the barrel of the reel and forms a loop, part of which may extend outside the space occupied by the coil and consequently be accessible on the fully-wound reel. However, experience has shown that this mechanism and others like it do not accomplish the purpose for which they were designed. As a matter of fact, the loop of wire which is formed by centrifugal force is subjected to tractional stress as the turns gradually pile up, so that at the end of winding, this loop is completely buried in the coil on the reel.

It is an object of this invention to provide an improved high-speed winding machine comprising a mechanism for eliminating the aforementioned drawback by compelling the formation of a leading end of wire of a predetermined length which is accessible outside the coil, this leading end being caused to form by a control means acting upon the winding machine from outside after winding of the reel has started.

To this end, in the winding machine according to the present invention, of the type initially mentioned, the improvement comprises an uncoiling member included in the snagging mechanisms and likewise coaxial with the reel, movable relative to the hook-bearing disk, and intended to receive the leading end of the wire at the time of the lagging movement, the control means being arranged for producing a relative displacement of limited amplitude between the uncoiling member and the hook-bearing disk, this displacement being separate from the lagging movement and bringing the leading end of the coil into a retaining position.

Figure 2:
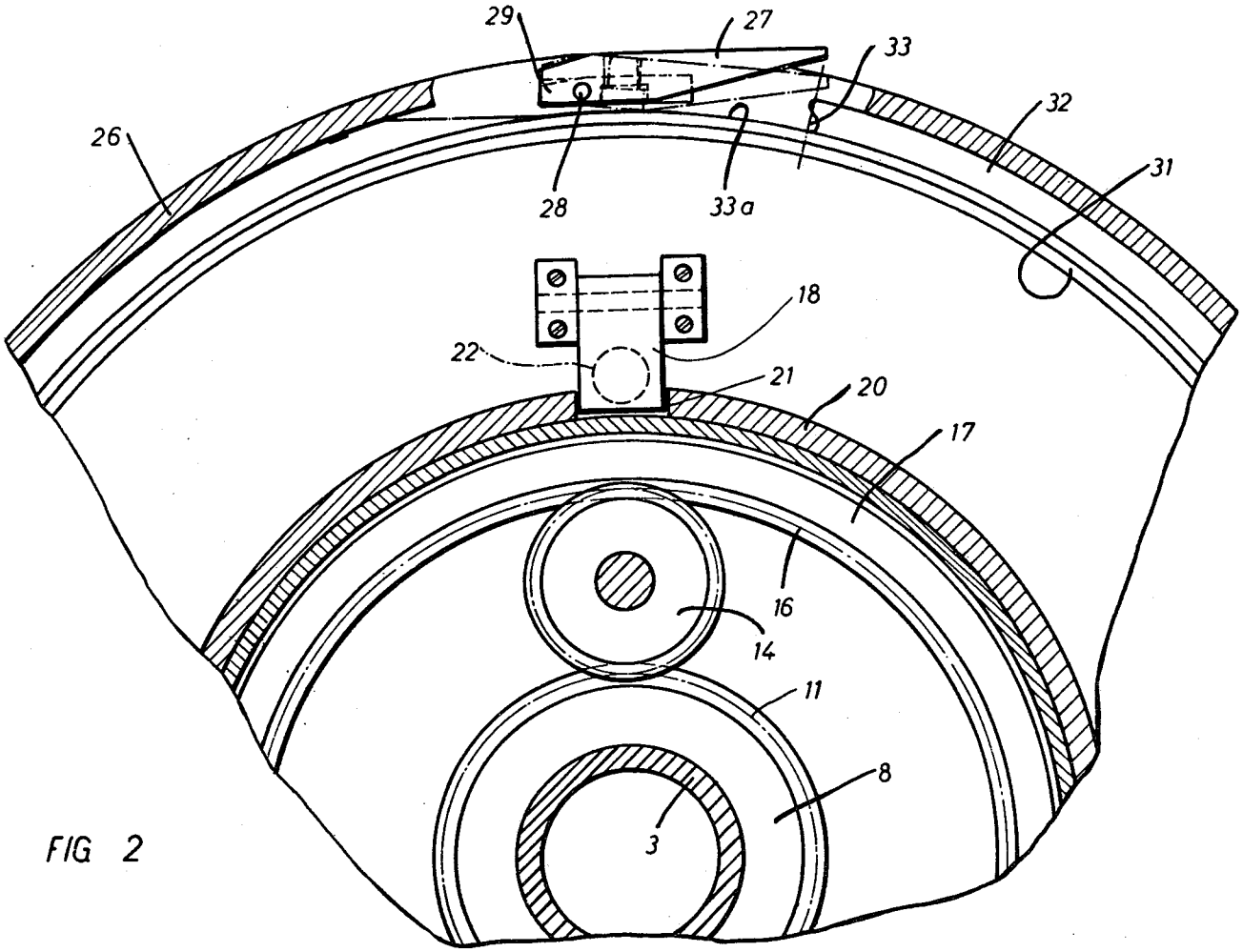
Figure 4A:
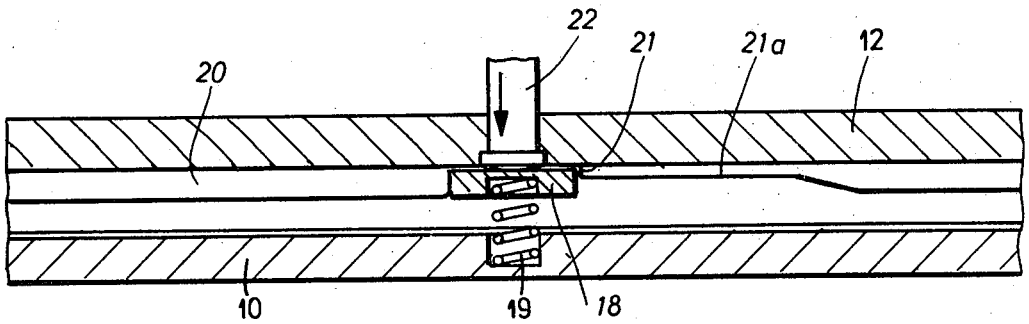
Figure 4B:
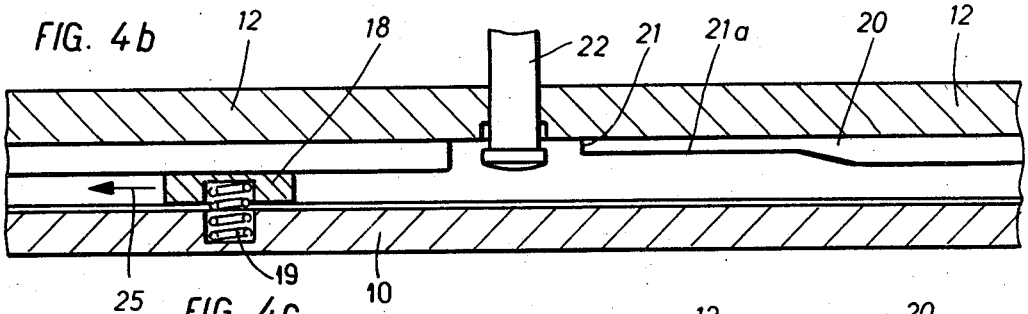
Figure 4C:
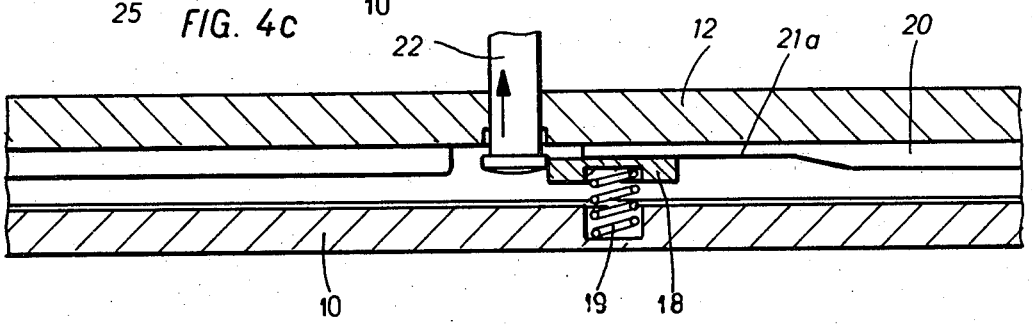
Figure 3:
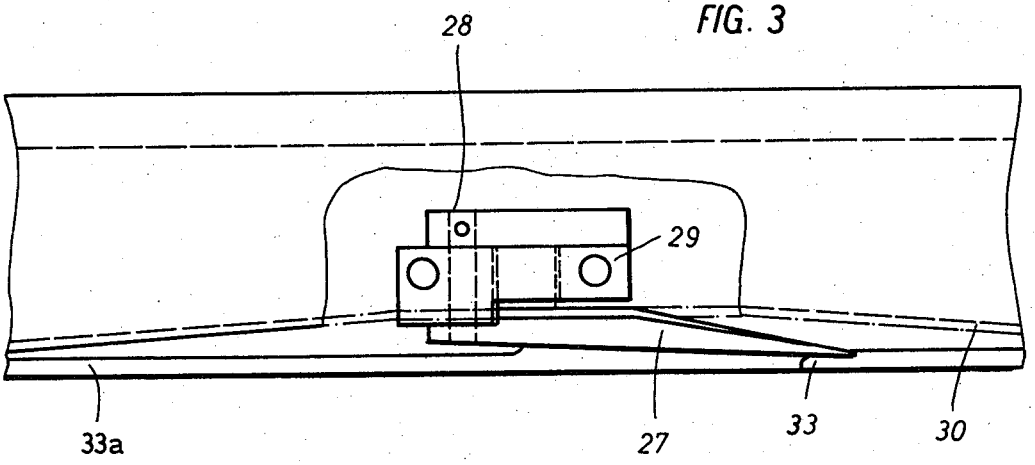
Figure 6A:
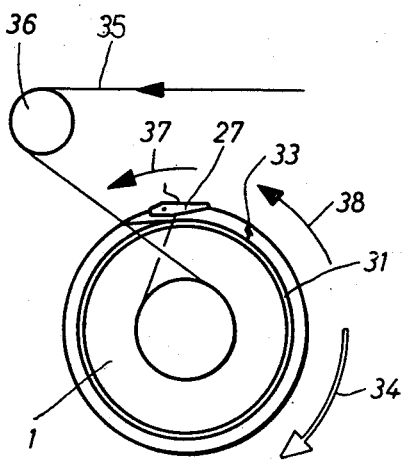
Figure 6B:
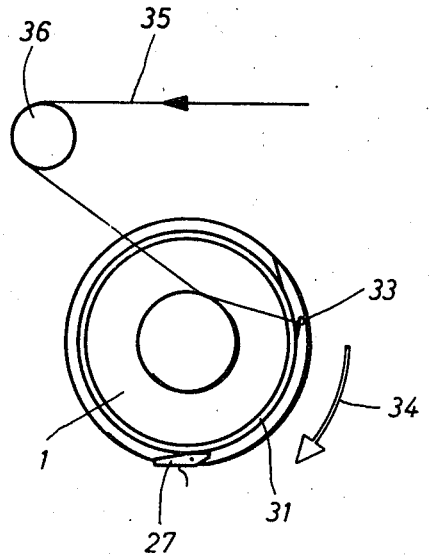
Figure 5:
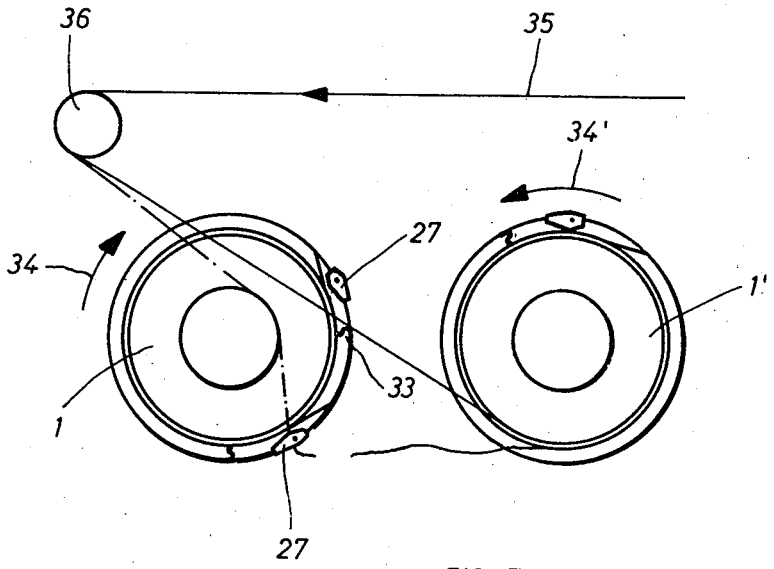
Figure 7:
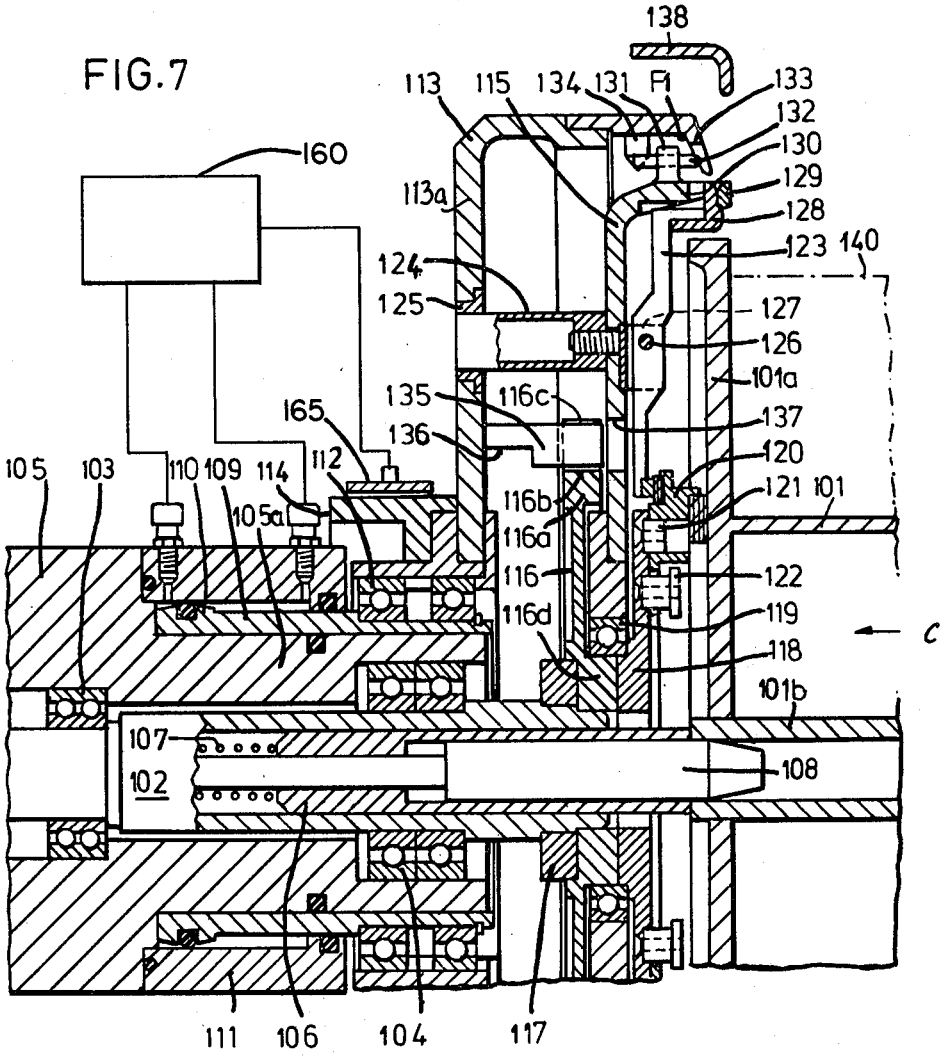
Figure 8:
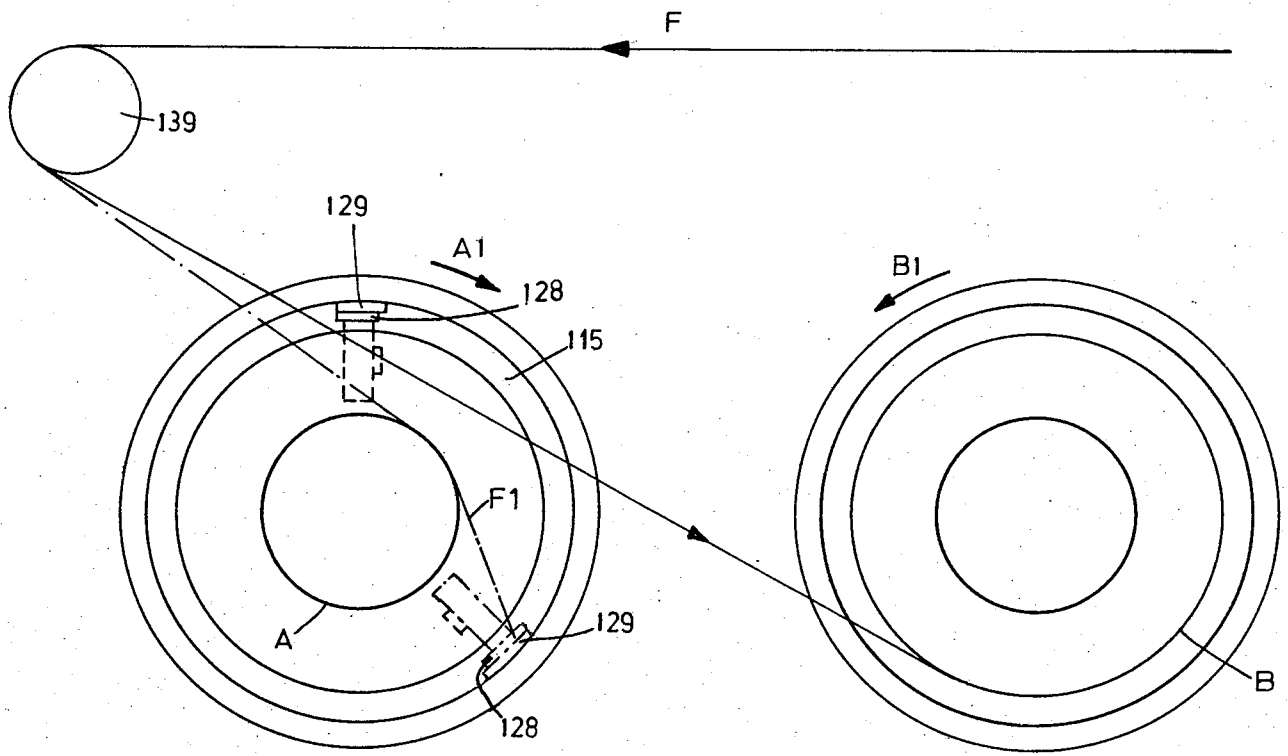
Figure 10:
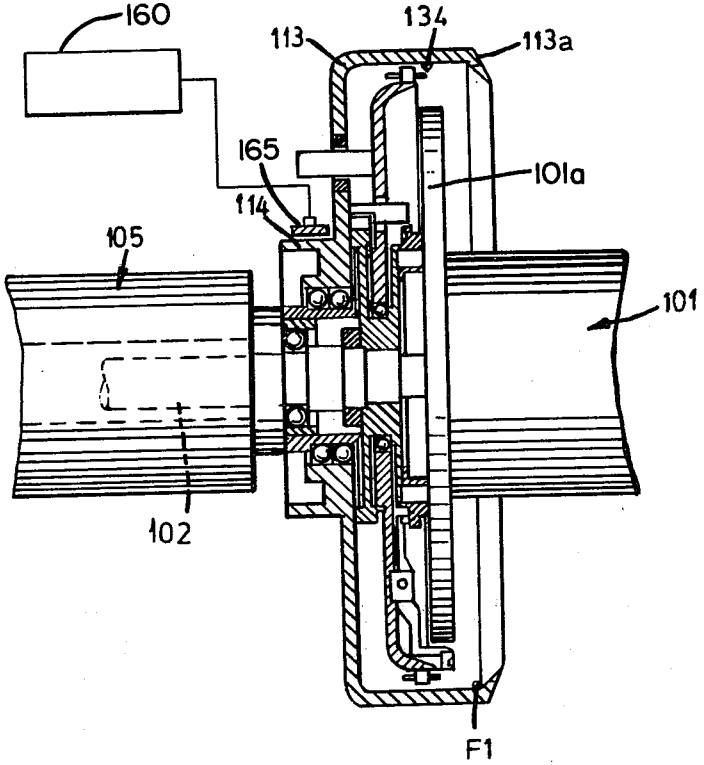
Figure 9:
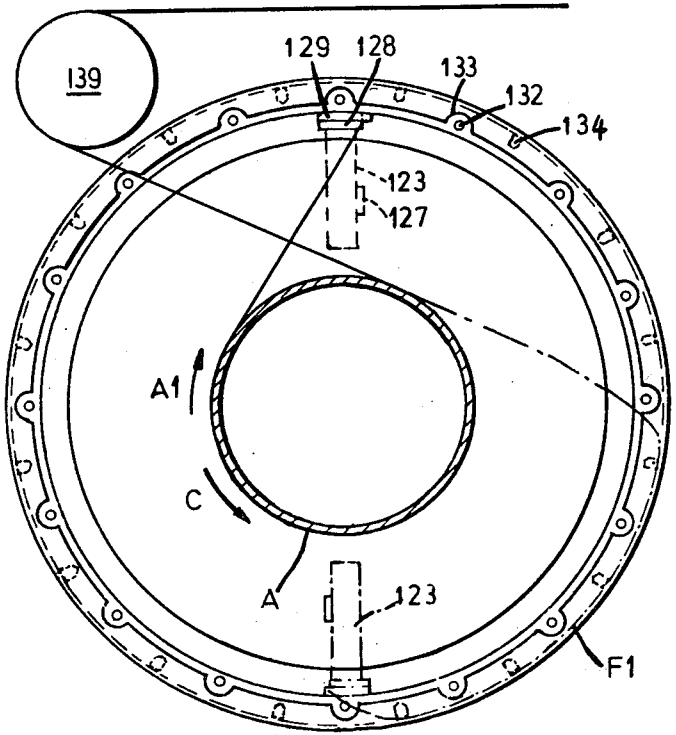

Two preferred embodiments of the invention will now be described in detail with reference to the accompanying drawings, in which:

FIG. 1 is a partial sectional view of a first embodiment of the winding machine according to the invention, FIG. 2 is a section taken on the line II—II of FIG. 1, in the direction of arrow A, FIG. 3 is a partial developed view showing the snagging member, FIGS. 4*a*, 4*b*, and 4*c* are partial developed views of a locking mechanism in three different operating positions, FIG. 5 is a diagrammatic elevation showing two successive positions of the winding machine at the moment of the transfer, FIGS. 6*a* and 6*b* are diagrammatic views of two positions of a device for forming a wire reserve, FIG. 7 is an axial section on a larger scale showing one of the snagging mechanisms in a normal operating position in a second embodiment of the invention, FIG. 8 is a diagrammatic elevation on a smaller scale, illustrating the start of the transfer operation, FIG. 9 is a diagrammatic view showing an empty reel and illustrating the operation of forming a loop with the leading end of the wire, and FIG. 10 is an axial section through the snagging mechanism in operating position.

Figure 11:
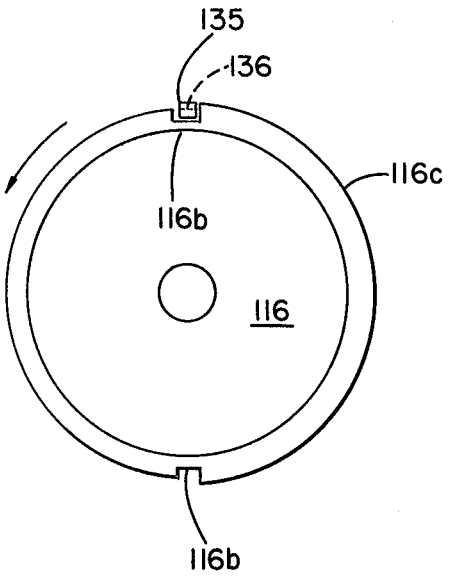

FIG. 11 is an isolated view of the disk and coupling finger mechanism of FIG. 7, taken along the longitudinal axis of the shaft, in the direction of arrow C.

FIG. 1 shows the parts of the winding machine which are necessary for understanding how the transfer operations are carried out. A reel 1 having a flange 1*a* and a barrel 1*b* is supported by means of a retractable mandrel 2 coaxial with a drive shaft 3 coupled to a variable-speed drive means (not shown). A bearing 4 supports shaft 3 relative to a fixed upright 5 forming part of the frame of the winding machine. Another pivoting device is naturally provided at the other end of reel 1, and the winding machine also includes a second reel support for another reel similar to reel 1 so that the reels can be wound alternately on one support and the other. The automatic transfer mechanism is not shown in the drawing; it may be of any type known in the art.

Flange 1*a* of reel 1 is made integral with drive shaft 3 by an annular friction pad 6 borne by a driving disk 7 fixed to an annular intermediate part 8 which is welded to shaft 3. Part 8 includes a guide groove 9 which engages the inner edge of an aperture in a disk 10 constituting the flange of an uncoiling member, as will be seen below. Next to groove 9, ring 8 also includes pinion teeth 11 and forms the sun gear of a planetary gearing. A planet-carrier disk 12 of this gearing is mounted on shaft 3 by means of a bearing 13. Disk 12 bears one or more planet pinions 14, the spindles of which are supported by bearings 15, and the teeth of which mesh simultaneously with pinion teeth 11 of sun gear 8 and with internal teeth 16 of a ring gear 17 integral with disk 10. Thus, disk 12 and disk 10 are kinematically linked by planet pinion or pinions 14. If disks 10 and 12 are locked to one another, they are driven by shaft 3 at the same speed as reel 1, and the whole assembly rotates as a single part. If, on the other hand, disks 10 and 12 are released from one anothr, and if, by means of an external mechanism, a speed of rotation lower than that of shaft 3 is imposed, e.g., by braking, on one of them, e.g., disk 12, then disk 10 is driven at a different speed from disk 12 and shaft 3, this speed being governed by the gear ratios of the components described.

Normally, disks 12 and 10 are made integral by means of a locking mechanism comprising a rocker 18 pivoted on disk 10, a spring 19, and a circular ramp 20 having slots 21 (FIGS. 2 and 4). Slotted ramp 20 is fixed to disk 12 coaxially with shaft 3. As may be seen in FIGS. 4*a*, 4*b*, 4*c*, ramp 20 has at least one break forming slot 21, preceded by an entry 21*a* which is slightly wider than rocker 18, also shown in these drawing figures. Although only one slot 21 is shown in the drawing, it will be obvious that depending on the embodiment desired, two or more slots may be provided at regular intervals along ramp 20. In line with each slot 21, disk 12 has a bore in which a disengagement finger 22 is inserted. All the fingers 22 are borne by an annular plate 23 coaxial with reel 1, the inner edge of plate 23 passing between the jaws of an axially displaceable brake 24.

As long as brake 24 is in the position shown in FIG. 1, rocker 18 remains engaged in slot 21, and disks 10 and 12 are integral with one another and rotate at the same speed as shaft 3, planet pinion or pinions 14 acting as keys. If, on the other hand, by means of a control movement which need not be shown here, brake assembly 24 is shifted to the right, as viewed in FIG. 1, while its jaws are clamped against annular plate 23, disengagement fingers 22 pass through their openings in disk 12 and press against the lower ends of rockers 18, disengaging them from slots 21. From then on, disks 10 and 12 are unlocked from one another; and as disk 12 is braked by means of fingers 22 and annular plate 23, it slows down relative to shaft 3. Disk 10 is then driven via planet pinions 14 and will rotate relative to shaft 3 and relative to disk 12 at a speed which will depend upon the ratios of the gears.

As will be apparent from FIG. 4*b*, the direction of rotation of disk 10 is such that rocker 18 moves in the direction of arrow 25 relative to disk 12. When disk 10 has moved over an arc of a certain length, it will once more be in an entry 21*a* and in front of a slot 21, so that it will again lock disks 10 and 12 to one another if disengagement fingers 22 have meanwhile been withdrawn. If, on the other hand, fingers 22 have not been withdrawn, the unlocked condition will persist and can be prolonged at will.

A description will now be given of how disks 10 and 12 are arranged at their peripheries. Disk 12 is provided with a cylindrical peripheral wall 26 as shown in FIGS. 1 and 2. At one or more points along its circumference, wall 26 is equipped with a snagging member 27 which pivots about an arbor parallel to the axis of rotation of reel 1. Arbor 28 is mounted in a support stud 29 fixed to the inside of cylindrical wall 26, which includes an elongated notch 30 in line with stud 29 in order to create the necessary room for the operation of snagging member 27. Acted upon by centrifugal force, member 27 will be urged outward and will press against the oblique edge face of wall 26 at the location of elongated notch 30.

The two pivoting extremes of snagging member 27 will be seen in FIG. 2.

Disk 10 constitutes the flange of an uncoiling drum. It, too, is provided at its periphery with a cylindrical wall 31 (FIG. 1). Wall 31 constitutes the uncoiling member on which the length of wire intended to form the leading end is wound. Wall 31 is provided with a peripheral rim 32 having one or more cut-out portions 33*a* bounded at one end by a nose 33. Noses 33 and hooks 27 are coincident when disks 10 and 12 are locked to one another, as may be seen in FIG. 1. The details of notch 33*a* and nose 33 are likewise visible in FIG. 3.

FIGS. 5 and 6 illustrate the operation of the winding machine described above. FIG. 5 shows, diagrammatically, two reels 1 and 1' which are mounted on the winding machine and rotatingly driven in the directions indicated by arrows 34 and 34'. This drawing figure shows two different situations which succeed one another within a very short interval at the time of transfer. A wire 35 passes over a pulley 36, and in the first situation, it extends in a straight line from pulley 36 to the full coil on reel 1'. As may be seen, wire 35 is led so as to pass almost at a tangent to the barrel of reel 1. It is then deflected axially by a mechanism known per se (not shown), e.g., a wire-pusher, so as to press axially against the assembly formed by uncoiling member 10, 31, 33 and by hook-bearing disk 12, 26, 29, this assembly being made integral by rockers 18, as explained above. The first situation shown in FIG. 5 corresponds to the exact moment when nose 33 has passed under the length of wire tangent to reel 1', moving in the direction of arrow 34. Wire 35, urged axially, is therefore caught under hook 27. In the second situation, which occurs an instant later, the section of wire between pulley 36 and the point of snagging by hook 27 presses against the barrel of reel 1, and wire 35 snaps between hook 27 and the coil on reel 1. From that moment on, wire 35 will start to be wound on the barrel of reel 1, while the latter continues to rotate at a speed of rotation such that the linear speed of wire 35 remains exactly the same as it was upon the completion of winding on reel 1'.

It will be understood that after several revolutions, the wire is joined firmly enough to the barrel of reel 1 so that the holding and driving function performed by hook 27 while the first few turns of the coil were being laid down is no longer an indispensable function, and the leading end can be relaxed, for example, without this entailing any releasing of the coil. At this moment, the control means which cause the leading end to become attached to the uncoiling drum are actuated. For an understanding of the operation of the mechanism which has been described above, reference will be made to FIGS. 6*a* and 6*b*, which show reel 1 rotating in the direction of arrow 34, pulley 36, and the path followed by wire 35 coming from the entrance of the machine, passing over pulley 36, and then running at a tangent to the barrel of reel 1. In the situation illustrated in FIG. 6*a*, hook 27 and nose 33 of drum 31 are always in relative positions corresponding to the locking together of parts 12 and 10 (FIG. 5). This is the starting situation for putting the uncoiling mechanism into operation. If, starting from this situation, brake 24 is actuated, so that disengagement fingers 22 move axially and lift rockers 18 into the position shown in FIG. 4*b* while braking support 12 of hook 27, then support 12 will move relative to reel 1 in the direction indicated by arrow 37 (FIG. 6*a*). In other words, support 12 will be braked relative to reel 1. As for drum 31, as has been seen above, it will move in the same relative direction as the support of hook 27 but at a higher speed, as represented by arrow 38 which is longer than arrow 37. In other words, drum 31 is slowed down more than support 12 is. These relative movements cause nose 33 to approach hook 27, to snag the length of wire which extends between hook 27 and the barrel of reel 1 and which becomes slack because of the lagging movement of support 12 relative to reel 1, and to pass beyond hook 27. FIG. 6*b* shows, for example, the situation which exists when nose 33 has reached an orientation situated approximately 90° behind that of hook 27. This situation can obviously exist when reel 1 has made several revolutions in the direction of arrow 34, starting from the situation shown in FIG. 6*a*. It will be seen that the length of wire running from hook 27 toward the barrel of reel 1 is now laid down along an arc of about 90° on the cylindrical wall of drum 31. The flank of rim 32 prevents it from being disengaged over the whole length of the arc which runs from hook 27 to the location of nose 33. At this point, however, wire 35 leaves drum 31 and passes in front of flange 1*a* of reel 1 to arrive tangentially on the barrel of reel 1. Between nose 33 and hook 27, therefore, there is a length of wire laid down in an arc on drum 31, held taut between these two end members, and thus forming a fixed reserve of wire.

The situation shown in FIG. 6*b* can continue until re-locking of the uncoiling drum and the hook support as has been seen previously. If ramp 20 comprises two diametrically opposite slots 21, rocker 18, mounted on drum 31, will lock the two components together when nose 33 is at substantially 180° from the hook. In another embodiment, however, there could be three or four slots 21 along the circumference of ramp 20; and it will be seen that in the case of three slots, for example, relocking will occur when nose 33 is at 120° from hook 27. In each case, the length of the reserve of wire will correspond to the length of the arc extending between hook 27 and nose 33 at the moment when rocker 18 reengages a slot 21.

However, it is not necessary for hook-bearing disk 10 to bear only one hook 27, and the peripheral rim of drum 31 may likewise include several notches 33*a*, each forming a nose 33 at one end. If the number of hooks 27 and noses 33 is selected in keeping with the length of the arc over which the reserve of wire extends, the uncoiling mechanism can start off again from its end position at the time of winding a new reel. Each end position constitutes a starting position corresponding, for instance, to that of FIG. 2, beginning from which the movements of the nose and the hook relative to the reel support may take place.

In the embodiment described above, the uncoiling mechanism comprises an uncoiling drum coaxial to the reel and linked to the hook support by a planetary gear, on the one hand, and by a locking mechanism capable of being actuated from outside after winding of the reel has started, on the other hand. It will be obvious, however, that the scope of the present invention likewise includes any other design in which an uncoiling mechanism acts in such a way as to produce a reserve of wire by snagging two end points of a length of wire stretched between these two snagging points so that the length of the reserve of wire may be determined.

Thus, FIGS. 7–10 illustrate another embodiment of the winding machine according to the present invention.

FIG. 7 shows part of the means for driving a reel 101 mounted on a double winding machine with automatic transfer. This winding machine comprises two reel supports analogous to the one shown in FIG. 7. These reel supports are mounted on a common frame 105 so that the axes of the reels are parallel, and the winding machine is further equipped with a traverse mechanism and transfer means which are depicted diagrammatically in FIGS. 8 and 9 but which are of conventional design.

In FIG. 7, reel 101 is mounted on a drive shaft 102 borne by bearings 103 and 104 relative to fixed frame 105. Shaft 102 contains a gripping socket 106 biased by a spring 107 and pressing axially against the end of a hub 101*b* of reel 101. A reel-spindle 108 is fixed within shaft 102 so as to fit into hub 101*b* in order to support reel 101 along its axis. Shaft 102 is driven by an electric motor via a pulley (not shown) and a transmission belt.

For receiving bearing 104, frame 105 has a tubular extension 105*a* bounded by a smooth outer cylindrical surface onto which a likewise tubular sleeve 109 can be slipped. The rearward end of sleeve 109 exhibits a bulge 110 which constitutes a piston capable of sliding within a cylinder 111 of a jack which is operated by control means 160. On the end of sleeve 109 which projects from cylinder 111 there is a bearing 112 upon which part of a movable assembly rotates. This part of the assembly is composed of an arcuate wire-uncoiling guard 113 and a brake drum 114. A second part of this assembly, borne by a bearing 119, will be described below. Parts 113 and 114 are free to rotate relative to sleeve 109 and coaxially therewith but are moved axially by sleeve 109, their extent of travel being determined by the length of cylinder 111. In FIG. 7, parts 113 and 114 are shown in their withdrawn position, with piston 110 being situated at the left-hand end of cylinder 111 as viewed in that drawing figure. The second part of the movable assembly cannot be displaced axially. It comprises a hook-bearing disk 115 which is likewise free to rotate relative to drive shaft 102. It will be noted that the right-hand end of drive shaft 102, as viewed in FIG. 7, bears a coupling disk 116 having at its periphery a rim 116*a* provided along its circumference with notches 116*b* and a projecting stop member 116*c*. Moreover, a connection is established between disk 116 and drive shaft 102 by means of a hub-shaped center part 116*d* of disk 116 which engages and is fixed to a support ring 117 welded to shaft 102. A flange 118 is also fixed coaxially to shaft 102 against hub 116*d* in order to hold bearing 119, mounted on hub 116*d* and supporting disk 115, in place. Flange 118 in turn bears a composite friction ring 120 which is guided by nibs 121 integral with flange 118. Ring 120 is axially movable on nibs 121, is held in place by stops 122, likewise fixed to flange 118, and bears against flange 101*a* of reel 101, on the one hand, and against the foot of a hook 123, on the other hand. When reel 101 is put in place, flange 101*a* thereof presses against ring 120 and pushes it into the position shown in FIG. 7, in which position it keeps hook 123 closed, as will be seen below.

Returning now to the freely rotatable assembly comprising brake drum 114 and guard 113, this assembly further includes hook-bearing disk 115, to the rear face of which three sockets such as socket 124 are fixed, each slidable in a corresponding eyelet 125 in guard 113. Since hook-bearing disk 115 is in a fixed axial position relative to drive shaft 102, when guard 113 moves axially, eyelets 125 slide on sockets 124.

As may be seen in FIG. 7, hook 123 is composed of a sectional bar mounted radially on the right-hand face, as viewed in FIG. 7, of hook-bearing disk 115. Hook 123 is pivoted about an arbor 126 relative to disk 115 by means of a stirrup-piece 127 fixed to the latter. Secured to a right-angle bend at the end of hook 123 nearest the periphery of disk 115 is a movable jaw 128 shaped to match a corresponding fixed jaw 129 which is integral with disk 115. Jaw 129 is in the shape of a finger extending along the periphery of disk 115 and connected at one end to an outer portion 130 of disk 115 which forms the rim thereof. Outer portion 130, which, as may be seen in FIG. 7, juts out toward the right-hand side of that drawing figure so as to be situated just back of flange 101*a* of reel 101, acts as an anti-retraction drum in the winding machine in question. Outer portion 130 bears projecting studs 131 distributed along the periphery of its outer face, each stud 131 having an axial hole in which a finger 132 is inserted.

Hook 123, jaws 128 and 129, and fingers 132 also appear diagrammatically in FIG. 9, which shows how the edge of uncoiling guard 113 is provided with notches 133 surrounding fingers 132. This drawing figure also shows disengagement fingers 134 which are fixed to the inner face of wire guard 113, and the function of which will be explained below.

Before describing the operation of this snagging mechanism, an explanation will be given of the disengageable coupling means included in the movable assembly for coupling it to or releasing it from drive shaft 102. A coupling finger 135 having an indentation 136 is fixed in an axial direction to the right-hand face, as viewed in FIG. 7, of wire guard 113. As depicted in that drawing figure, the right-hand end of finger 135 engages a notch 116*b* of coupling disk 116. Hook-bearing disk 115 and wire guard 113 being coupled by sockets 124, the movable assembly is driven by shaft 102 when in the position shown in FIG. 7. It will be realized, however, that if jack 111 is actuated by control means 160, and if tubular sleeve 109 moves wire guard 113 toward the right, finger 135 enters an opening 137 which is angularly shifted relative to hook 123, so that indentation 136 becomes aligned with notch 116*b*, and the coupling is released.

FIG. 10 shows on a smaller scale the parts described above in this advanced position of wire-uncoiling guard 113. It will be readily understood that brake shoe 165 facing brake drum 114 can then be actuated by control means 160 to slow down the movable assembly relative to drive shaft 102. This assembly will thus lag relative to shaft 102 until the base of finger 135 strikes against stop 116*c*. The movable assembly will then have dropped back by about 180° relative to drive shaft 102.

FIG. 11 illustrates the time at which finger 135 strikes stop 116*c*.

FIGS. 8 and 9 show diagrammatically the sequence of operations from the moment of transfer until the snagging mechanism is ready to return to its usual place. At the time of transfer, the snagging mechanisms of the two reels are in the position shown in FIG. 7. However, conventional wire guard 138 such as the type disclosed in U.S. Pat. No. 3,661,335, associated with the full reel B (FIG. 8) is in the advanced position so as to receive the trailing or outside end of the winding. In FIG. 8, a wire F coming from a processing line passes over a pulley 139 forming part of the traverse mechanism and is laid down on reel B driven in the direction of arrow B1, whereas reel A, still empty, is driven in the direction of arrow A1. Transfer means (not shown) deflect wire F into the path of jaws 129 and 128 which are rotating with disk 115 at the speed of the drive shaft of reel A. An instant later, jaws 128 and 129 are in the position shown in dot-dash lines in FIG. 8, and it will be seen that wire F has been severed or cut between the two reels. The leading end of the new winding runs at a tangent to the barrel of reel A, and after a few revolutions the arrangement is that shown in solid lines in FIG. 9.

It shall now be assumed that between the leading end snagged between jaws 129 and 128 and the length of wire F passing over pulley 139, a certain number of turns have been laid down on the barrel of reel 101 in the vicinity of its flange 101*a*, so that the start of the winding is fixed to the barrel of the reel. At this moment, jack 111 is operated by control means 160 so that the movable assembly is caused to assume the position shown in FIG. 10. The axial position of traverse pulley 139 is then such that the wire is not hindered by the advance of guard 113. Application of the brake shoe 165 to drum 14 causes the relative dropping back of the movable assembly in the direction of arrow C in FIG. 9, so that the whole movable assembly, including hook 123, comes into the position shown in dot-dash lines in FIG. 9. Leading end F1 then forms a loop which, under the effect of centrifugal force, is laid down in guard 113 between rim 113*a* and fingers 134. Jack 111 is then actuated by control means 160 to return guard ring 113 to the position of FIG. 7, so that leading end F1 comes to be placed above fingers 132 of anti-retraction drum 130. Wire F remains gripped between jaws 128 and 129, so that during the formation of winding 140 the retractive force exerted upon leading end F1 will cause the loop to be laid down on fingers 132.

When the winding operation is finished and reel A has become a full reel, the transfer operation is repeated as described above. With the object of facilitating unloading of the reels, each snagging mechanism is equipped with a marking element, e.g., a reflective tape affixed at a certain location to the periphery of guard 113 or of hook-bearing disk 115. This reflective tape cooperates with a detection system, e.g., a lamp and a photoelectric cell, or any other electro-optical device capable of transmitting a signal when the snagging mechanism reaches a predetermined position. These means make it possible to stop drive shaft 102 in an orientation such that leading end F1 is situated above the axis of the reel. Jack 111 is then actuated in order to cause guard 113 to come out. Disengagement fingers 134 extract leading end F1 from anti-retraction drum 130, and leading end F1 falls onto the winding. Guard 113 can then be returned by actuating jack 111 in the opposite direction, after which the unloading operations are carried out normally. When a reel is full, the full reel can be easily removed to make room for an empty reel. The reel-spindle opposite reel-spindle 108 is displaced axially in order to disengage the reel. Spring 107, acting upon socket 106, pushes reel 101 out of reel-spindle 108, so that disk 120 is released. Hook 123 (which is biased by a spring) then pivots counterclockwise, as viewed in FIG. 7, thus opening jaws 128 and 129. The mechanism is then rotated without the reel being driven in order to disengage hook 123 from leading end F1. The reel can then be removed.

It suffices, finally, to reset the mechanism described, which can be done automatically by very simple control means. The mechanism is thus ready to receive a new empty reel, and these operations can easily be carried out during the time it takes for the parallel mechanism to fill the following reel.

The advantage of the mechanisms described above is that the length of the reserve of wire is independent of any variations in the kinematic conditions according to which the wire is laid down on the barrel of the reel to form the coil, so that the presence of leading ends of a predetermined length can be guaranteed on all the reels.

Winding machines thus equipped can therefore automatically supply series of reels completely wound with wire, with both ends of the winding easily accessible for carrying out the necessary testing.

Another advantage of the mechanism described, as compared with previously known mechanisms in which the hook-bearing disk was able to retreat by a certain angle relative to the reel support, is that resetting of the mechanism can be completely automatic.

What is claimed is:

1. A double winding machine with automatic transfer for continuously winding metal wire on reels which each have a barrel, comprising:

two reel supports with parallel drive shafts, each equipped with a snagging mechanism for snagging a leading end of wire to be wound;

each snagging mechanism comprising a hook-bearing disk with a hook, an uncoiling member, and bearing means for supporting said hook-bearing disk and said uncoiling member coaxially with respect to the reel and for permitting a relative displacement from an initial position to a displaced position between said disk and said uncoiling member;

disengageable coupling means for rotationally coupling said disk, said uncoiling member and said reel;

means for translationally disengaging said coupling means;

means for braking said hook-bearing disk to produce a lag of said disk with respect to said reel in order to lengthen said leading end; and means for performing said relative displacement at the time of said lag, said lengthened leading end being thus retained through said hook and said uncoiling member.

2. A double winding machine according to claim 1, wherein said uncoiling member comprises a cylindrical drum which extends between said hook-bearing disk and said reel, and a nose protruding from said drum for snagging said leading end between the hook and the barrel of said reel during said relative displacement.

3. A double winding machine according to claim 2, wherein said means for performing said relative displacement comprises means for performing a movement of relative lag for said uncoiling member with respect to said reel and said hook-bearing disk, the amplitude of said relative lag being greater than the lag of said hook-bearing disk with respect to said reel.

4. A double winding machine as claimed in claim 3, wherein said hook-bearing disk is provided with a pivoting hook capable of being biased by centrifugal force and cooperating with a support ramp so as to grip said wire when said reel is in motion.

5. A double winding machine according to claim 3, wherein said uncoiling member and said hook-bearing disk are integral with elements constituting coaxial components of a planetary gear train.

6. A double winding machine according to claim 5, wherein said planetary gear comprises a planet carrier integral with said hook-bearing disk, a ring gear having internal teeth and made integral with said uncoiling drum, and a sun gear integral with said drive shaft.

7. A double winding machine according to claim 6, wherein said snagging mechanism further comprises locking means for locking said uncoiling drum relative to said hook-bearing disk during winding of said reel.

8. A double winding machine according to claim 7, wherein said control means comprise unlocking means which, when actuated, cause the unlocking of said hook-bearing disk relative to said uncoiling drum, and braking means for acting upon said hook-bearing disk so that, the speed of rotation of said drive shaft remaining constant, said uncoiling drum effects a rotary displacement relative to said hook-bearing disk, this displacement being produced by the planet pinion or pinions, and said leading end being then laid down on said uncoiling drum.

9. A double winding machine according to claim 7, wherein said locking means comprise a rocker biased by a spring and mounted on a flange bearing said uncoiling drum, and a circular ramp integral with said hook-bearing disk, said ramp exhibiting at least one slot in which said rocker may engage under the bias of said spring for making the two parts integral.

10. A double winding machine according to claim 8, wherein said locking means comprise a rocker biased by a spring and mounted on a flange bearing said uncoiling drum, and a circular ramp integral with said hook-bearing disk, said ramp exhibiting at least one slot in which said rocker may engage under the bias of said spring for making the two parts integral, and wherein said unlocking means comprise a disengagement finger which slides in an opening in said hook-bearing disk and the displacement of which causes said rocker to leave said slot.

11. A double winding machine according to claim 1, wherein said uncoiling member comprises a cylindrical wire guard which extends around said hook-bearing disk and which is able to retain a loop formed by said leading end under the action of centrifugal force when said disk is in said displaced position.

12. A double winding machine according to claim 11, wherein said means for performing said relative displacement comprises means for axially displacing said uncoiling member from a retracted to an advanced position, said cylindrical wire guard partially protruding around the barrel of said reel when in said advanced position.

13. A double winding machine according to claim 12, wherein said hook-bearing disk comprises a peripheral outer rim portion provided with retaining fingers for receiving said leading end after said uncoiling member has returned to the retracted position.

14. A double winding machine according to claim 12, wherein said uncoiling guard is borne by a tubular hydraulic piston coaxial with said drive shaft and cooperating with a cylinder of a double-acting jack which ensures its axial displacements.

15. A double winding machine according to claim 12, wherein said uncoiling guard and said hook-bearing disk are continuously coupled to one another so as to rotate jointly.

16. A double winding machine according to claim 15, wherein the hook-bearing disk and the guard are each provided with a flange and the flanges of said hook-bearing disk and of said guard are joined through axial rods and corresponding eyelets in which said rods are inserted.

17. A double winding machine according to claim 12, further comprising a disengageable coupling between said drive shaft and said guard, said coupling being arranged so as to be disengaged when said guard is in advanced position and engaged when said guard is in retracted position.

18. A double winding machine according to claim 17, further comprising deceleration means capable of acting upon said guard when the latter is in advanced position, and a stop for limiting the extent of the moment of lag of said guard relative to said drive shaft.

19. A double winding machine as claimed in any one of the claims 11 to 18, wherein a rotary component integral in rotation with said drive shaft bears a marking element, and wherein a detection means is disposed facing said marking element and cooperates therewith so as to be able to control the stopping of said drive shaft in a predetermined orientation of said marking element and consequently of said hook.

* * * * *